US008308508B2

(12) United States Patent
Suzuki et al.

(10) Patent No.: US 8,308,508 B2
(45) **Date of Patent: *Nov. 13, 2012**

(54) CONNECTOR

(75) Inventors: Sachio Suzuki, Hitachi (JP); Hideaki Takehara, Hitachi (JP); Kunihiro Fukuda, Tsukuba (JP); Yuta Kataoka, Hitachi (JP); Jun Umetsu, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/137,966

(22) Filed: Sep. 22, 2011

(65) Prior Publication Data

US 2012/0184149 A1 Jul. 19, 2012

(30) Foreign Application Priority Data

Jan. 14, 2011 (JP) ..... 2011-005828

(51) Int. Cl.
*H01R 13/60* (2006.01)

(52) U.S. Cl. ..... 439/540.1

(58) Field of Classification Search ..... 439/540.1, 439/541.5, 701, 717, 715
See application file for complete search history.

(56) References Cited

U.S. PATENT DOCUMENTS

| | | | | |
|---|---|---|---|---|
| 7,666,027 | B2 * | 2/2010 | Takehara | 439/489 |
| 7,794,247 | B2 | 9/2010 | Suzuki | |
| 7,892,038 | B1 * | 2/2011 | Kataoka et al. | 439/660 |
| 7,922,518 | B1 * | 4/2011 | Takehara et al. | 439/485 |
| 7,955,110 | B1 * | 6/2011 | Kataoka et al. | 439/284 |
| 7,959,470 | B1 * | 6/2011 | Umetsu et al. | 439/626 |
| 7,980,879 | B2 * | 7/2011 | Suzuki et al. | 439/346 |
| 7,985,092 | B2 * | 7/2011 | Suzuki et al. | 439/346 |
| 8,100,708 | B2 * | 1/2012 | Kataoka et al. | 439/271 |
| 8,105,099 | B2 * | 1/2012 | Suzuki et al. | 439/157 |
| 8,123,546 | B2 * | 2/2012 | Suzuki et al. | 439/372 |
| 2009/0075506 | A1 | 3/2009 | Suzuki | |
| 2012/0052747 | A1 * | 3/2012 | Kataoka et al. | 439/701 |

FOREIGN PATENT DOCUMENTS

| | | | |
|---|---|---|---|
| JP | 2004-056924 | A | 2/2004 |
| JP | 4037199 | B2 | 11/2007 |
| JP | 2009-70754 | A | 4/2009 |

* cited by examiner

*Primary Examiner* — Tulsidas C Patel
*Assistant Examiner* — Phuongchi Nguyen
(74) *Attorney, Agent, or Firm* — McGinn IP Law Group, PLLC

(57) ABSTRACT

A connector includes a first terminal housing for housing three first connecting terminals aligned, a second terminal housing for housing three second connecting terminals aligned, a plurality of insulating members that are aligned and housed in the second terminal housing, and a connecting member for collectively fixing and electrically connecting the three first connecting terminals and the three second connecting terminals at each contact point by pressing one of the plurality of insulating members adjacent to the connecting member. The three first connecting terminals and the three second connecting terminals are each arranged in a form of a triangle when viewed in the fitting direction.

5 Claims, 4 Drawing Sheets

1 CONNECTOR
5 FIRST TERMINAL HOUSING
7 SECOND TERMINAL HOUSING
60a-60c, 61a-61c CABLE 4a-4c FIRST CONNECTING TERMINAL
5 FIRST TERMINAL HOUSING
6a-6c SECOND CONNECTING TERMINAL
9 CONNECTING MEMBER
60a-60c, 61a-61c CABLE 4a-4c FIRST CONNECTING TERMINAL
5 FIRST TERMINAL HOUSING
6a-6c SECOND CONNECTING TERMINAL
7 SECOND TERMINAL HOUSING
8a-8d INSULATING MEMBER
9 CONNECTING MEMBER
94 PRESSING PORTION 4a-4c FIRST CONNECTING TERMINAL
6a-6c SECOND CONNECTING TERMINAL
8a-8e INSULATING MEMBER
94 PRESSING PORTION

CONNECTOR

The present application is based on Japanese patent application No. 2011-005828 filed on Jan. 14, 2011, the entire contents of which are incorporated herein by reference.

BACKGROUND OF THE INVENTION

1. Field of the Invention

The invention relates to a connector which is used for, e.g., an eco-friendly car such as a hybrid car and an electric car and, in particular, to a connector that may be used as a connecting portion of a power harness used for transmitting a large amount of power.

2. Description of the Related Art

A power harness is used for connecting between devices such as between a motor and an inverter or between an inverter and a battery in, e.g., a hybrid car or an electric car, which has made significant progress in recent years, for transmitting a large amount of power, and a connector in a two-divided structure composed of, e.g., a male connector portion provided with a male terminal as well as a first terminal housing for housing the male terminal and a female connector portion provided with a female terminal connected to the male terminal as well as a second terminal housing for housing the female terminal is provided to one end of the power harness (see, e.g., JP-A-2009-070754).

In recent years, all components in such an eco-friendly car have been reduced in weight to improve the energy saving performance, and one effective measure for reducing the weight may be downsizing.

For example, Japanese patent No. 4037199 discloses a downsizing technique.

Japanese patent No. 4037199 discloses an electric connection structure for vehicle in which connecting terminals of plural phases of conductive member led out from a vehicle driving motor are connected to connecting terminals of plural phases of power line cable led out from an inverter for driving the motor, a connecting terminal of each phase of the conductive member overlaps a corresponding connecting terminal of each phase of the power line cable, an insulating member is arranged on a surface opposite to an overlapping surface of the connecting terminals, and the overlapped connecting terminals of each phase are tightened and fixed to the insulating members in an overlapping direction by a single bolt provided at a position to penetrate therethrough.

In other words, Japanese patent No. 4037199 discloses the connection structure that the plural connecting terminals and the insulating members compose a laminated structure and the connecting terminals are fixed and electrically connected all together at contact points by tightening the single bolt in the overlapping direction (or the lamination direction) while the plural contact points between the connecting terminals as the overlapping surface thereof are sandwiched. The connection structure may be more effective than the technique of JP-A-2009-070754 in facilitating the downsizing.

SUMMARY OF THE INVENTION

Here, the inventors focused on applying such a laminated-type connection structure to the connector.

However, the above structure is poor in the bundling workability since the plural cables are arranged along the lamination direction in correspondence with the lamination direction of the connecting terminals, i.e., the plural cables being in planar arrangement. Thus, it is desired that the plural cables can be conclusively bundled for taking the cabling property into account when used for a wire harness. In addition, the bundled cables are advantageous because it can be easily inserted into a protection member such as aluminum pipe or corrugated tube.

Accordingly, it is an object of the invention to provide a laminated-type connector that the plural cables to be connected thereto can be easily bundled together.

(1) According to one embodiment of the invention, a connector comprises:

a first terminal housing for housing three first connecting terminals aligned;

a second terminal housing for housing three second connecting terminals aligned;

a plurality of insulating members that are aligned and housed in the second terminal housing;

a laminated structure that the three first connecting terminals and the three second connecting terminals are alternately arranged so that one surface of the three first connecting terminals faces one surface of the three second connecting terminals to form pairs and to form three contact points sandwiched between the plurality of insulating members when the first terminal housing is fitted to the second terminal housing; and a connecting member for collectively fixing and electrically connecting the three first connecting terminals and the three second connecting terminals at each contact point by pressing one of the plurality of insulating members adjacent to the connecting member, wherein the three first connecting terminals and the three second connecting terminals are each arranged in a form of a triangle when viewed in the fitting direction.

In the above embodiment (1) of the invention, the following modifications and changes can be made.

(i) The three contacts are formed between the three first connecting terminals and the three second connecting terminals such that the connecting member presses one terminal of the three first connecting terminals or the three second connecting terminals located at a vertex of the triangle, and the one of the three first connecting terminals or the three second connecting terminals located at the vertex of the triangle presses two parallel-arranged terminals of the three first connecting terminals or the three second connecting terminals located thereunder.

(ii) The three contacts are formed between the three first connecting terminals and the three second connecting terminals such that the connecting member presses two parallel-arranged terminals of the three first connecting terminals or the three second connecting terminals, and the two parallel-arranged terminals of the three first connecting terminals or the three second connecting terminals press one terminal of the three first connecting terminals or the three second connecting terminals located thereunder and at a vertex of the triangle.

(iii) The connector further comprises a resin molded body for holding three cables to be each connected to the three first connecting terminals such that the three cables are arranged in a form of a triangle when viewed in the fitting direction.

(iv) The connector further comprises a resin molded body for holding three cables to be each connected to the three second connecting terminals such that the three cables are arranged in a form of a triangle when viewed in the fitting direction.

Points of the Invention

According to one embodiment of the invention, a connector is constructed such that three first connecting terminals (aligned and housed in a first terminal housing) and three second connecting terminals (aligned and housed in a second terminal housing) are each arranged in the form of a triangle when viewed in the fitting direction of the first terminal housing and the second terminal housing. As a result, three cables each connected to the first and/or second connecting terminals are arranged in the form of the triangle when viewed in the fitting direction. This allows the three cables led out from the connector to be easily bundled together. Thus, the bundled cables can be easily inserted into a protection member with a cylindrical shape such as aluminum pipe or corrugated tube.

BRIEF DESCRIPTION OF THE DRAWINGS

Next, the present invention will be explained in more detail in conjunction with appended drawings, wherein:

FIGS. 4A and 4B are diagrams illustrating a first connecting terminal of the connector of FIG. 1, wherein FIG. 4A is a side view and FIG. 4B is a top view;

DETAILED DESCRIPTION OF THE PREFERRED EMBODIMENTS

A preferred embodiment of the invention will be described below in conjunction with the appended drawings.

Figure 1:
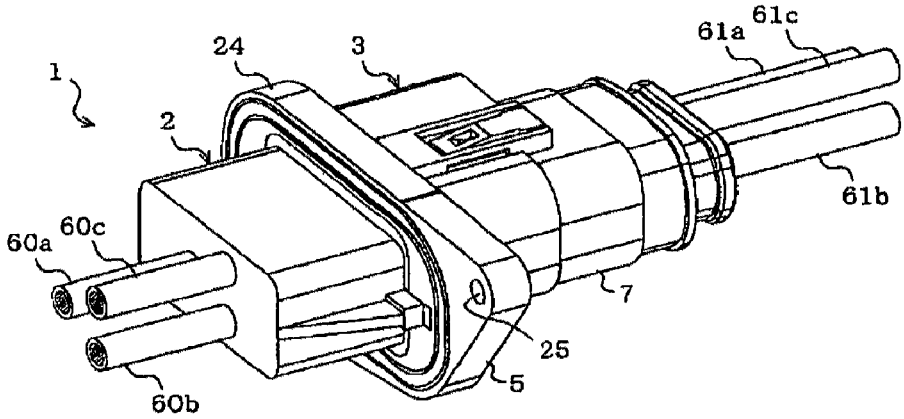
FIG. 1 is a perspective view showing a connector in an embodiment of the present invention.
Figure 2:
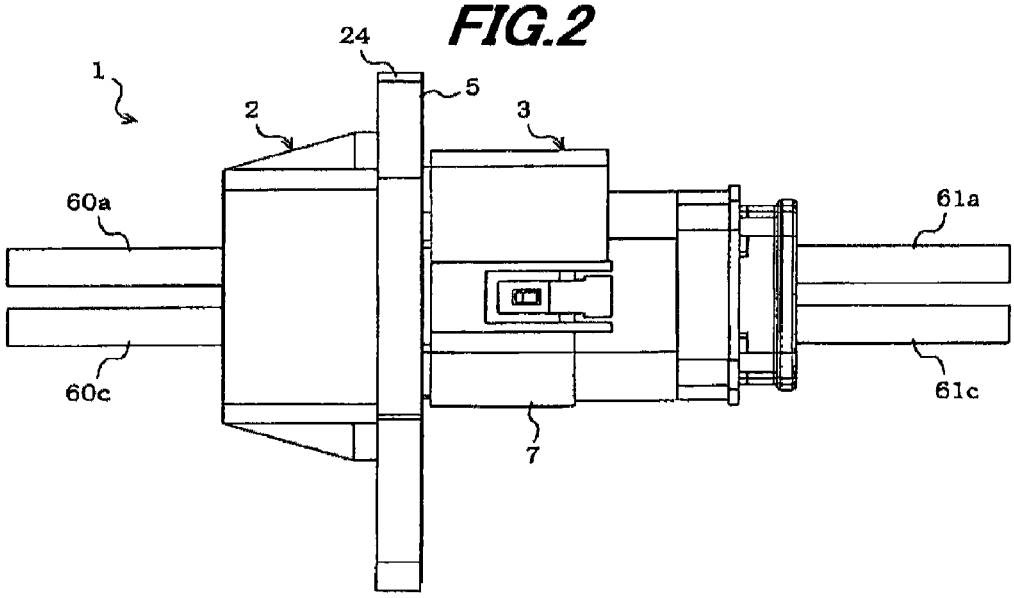
FIG. 2 is a side view showing the connector of FIG. 1.

FIGS. 1 and 2 are diagrams illustrating a connector in the present embodiment, wherein FIG. 1 is perspective view and FIG. 2 is a side view.

As shown in FIGS. 1 and 2, a connector 1 of the present embodiment is composed of a first connector portion 2 and a second connector portion 3, and three power lines are connected at a time by fitting the connector portions 2 and 3 together.

More specifically, the connector 1 is provided with the first connector portion 2 having a first terminal housing (i.e., male terminal housing) 5 housing three aligned first connecting terminals (i.e., male terminals) 4*a* to 4*c*, the second connector portion 3 having a second terminal housing (i.e., female terminal housing) 7 housing plural (three) aligned second connecting terminals (i.e., female terminals) 6*a* to 6*c*, and plural (four) insulating members 8*a* to 8*d* aligned and housed in the second terminal housing 7 for insulating contact points composed of the first connecting terminals and the second connecting terminals from each other, and the connector 1 is configured that, in the first terminal housing 5 of the first connector portion 2 and the second terminal housing 7 of the second connector portion 3 which are fitted to each other, the first connecting terminals 4*a* to 4*c* and the second connecting terminals 6*a* to 6*c* are alternately arranged to form a laminated structure in which surfaces of the plural first connecting terminals 4*a* to 4*c* on one side face surfaces of the plural second connecting terminals 6*a* to 6*c* on one side to form respective pairs (a pair of the first connecting terminal 4*a* and the second connecting terminal 6*a*, that of the first connecting terminal 4*b* and the second connecting terminal 6*b*, and that of the first connecting terminal 4*c* and the second connecting terminal 6*c*) and to form plural contact points, and each contact point is sandwiched by the insulating members 8*a* to 8*d*.

In the connector 1, cables 60*a* to 60*c* are connected to the first connector portion 2 and cables 61*a* to 61*c* are connected to the second connector portion 3, and the cables 60*a* to 60*c* are respectively electrically connected to the cables 61*a* to 61*c* by connecting the first connector portion 2 to the second connector portion 3. That is, the connector 1 is used to connect cables (cable-to-cable connection).

The connector 1 is used for connecting, e.g., a motor for driving a vehicle to an inverter for driving the motor. In the present embodiment, the cables 60*a* to 60*c* as cables extending from a motor and the cables 61*a* to 61*c* as cables extending from an inverter will be described as an example.

Each configuration of the first and second connector portions 2 and 3 will be described in detail below.

First Connector Portion

Firstly, the first connector portion 2 will be described.

Figure 3:
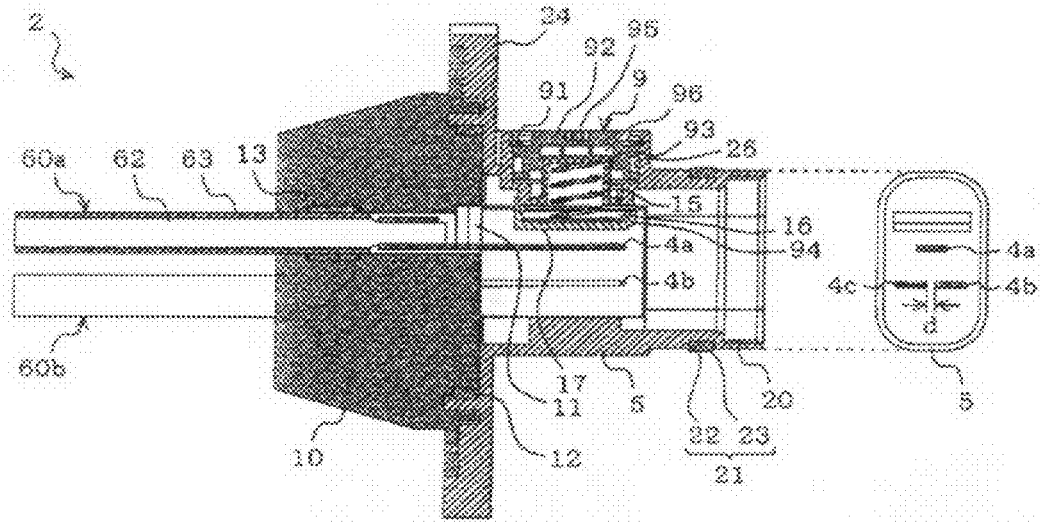
FIG. 3 is a diagram illustrating a first connector portion of the connector of FIG. 1.

As shown in FIGS. 1 to 3, the first connector portion 2 holds, inside thereof, three first connecting terminals 4*a* to 4*c* aligned at predetermined intervals, and is provided with the first terminal housing 5 housing the three aligned first connecting terminals 4*a* to 4*c* and a connecting member 9 for collectively fixing and electrically connecting the plural first connecting terminals 4*a* to 4*c* to the plural second connecting terminals 6*a* to 6*c* at respective contact points by pressing the adjacent insulating member 8*a* when the first terminal housing 5 is fitted to the second terminal housing 7.

The cables 60*a* to 60*c* extending from a motor are respectively connected to edges of the first connecting terminals 4*a* to 4*c* on one side. The cables 60*a* to 60*c* are each composed of a conductor 62 and an insulation layer 63 formed on the outer periphery thereof. The conductor 62 having a cross-sectional area of 20 $mm^2$ is used in the present embodiment.

Electricity of different voltage and/or current is transmitted to each of the cables 60*a* to 60*c*. For example, the present embodiment assumes the use of a three-phase AC power line between a motor and an inverter, and alternate current having a phase difference of 120° is transmitted to each of the cables 60*a* to 60*c* and the first connecting terminals 4*a* to 4*c*. Each of the first connecting terminals 4*a* to 4*c* should be formed of a highly conductive metal such as silver, copper or aluminum to reduce transmission loss, etc., in the connector 1. In addition, each of the first connecting terminals 4*a* to 4*c* has little flexibility.

The cables 60*a* to 60*c* are each aligned and held at predetermined intervals by a resin molded body (inner housing) 10 so as to be triangularly-arranged when viewed in a fitting direction. The first connecting terminals 4*a* to 4*c* are triangularly-arranged when viewed in a fitting direction and are fixed to the first terminal housing 5 via the cables 60*a* to 60*c* and the resin molded body 10.

At this time, it is necessary to determine a distance d between the adjacently-arranged first connecting terminals 4*b* and 4*c* so that insulation between the terminals is sufficiently ensured. It is obvious that it is necessary to determine the distance between the first connecting terminal 4*a* and the first connecting terminals 4*b*, 4*c* so as to ensure insulation therebetween, however, the design therefor is not as inflexible as the distance between the first connecting terminals 4*b* and 4*c* since the insulating members 8*b* and 8*c* are interposed therebetween.

The resin molded body 10 is formed of an insulating resin (e.g., PPS (polyphenylene sulfide) resin, PPA (polyphthalamide) resin, PA (polyamide) resin, PBT (polybutylene terephthalate) and epoxy-based resin), etc., to prevent short circuit by insulating the first connecting terminals 4*a* to 4*c* from each other. The resin molded body 10 allows the first connecting terminals 4*a* to 4*c* to be held at respective predetermined positions even when each of the cables 60*a* to 60*c* respectively connected to the first connecting terminals 4*a* to 4*c* is very flexible. In other words, since a cable excellent in flexibility can be used as the cables 60*a* to 60*c* in the present embodiment, it is possible to improve the wiring flexibility for laying the cables 60*a* to 60*c*.

The resin molded body 10 holds the cables 60*a* to 60*c* to position the first connecting terminals 4*a* to 4*c*, in more detail, the resin molded body 10 holds the end portion of the cables 60*a* to 60*c* at a position close to the first connecting terminals 4*a* to 4*c* so that the first connecting terminals 4*a* to 4*c* are held at predetermined positions, however, the resin molded body 10 may directly hold and position the first connecting terminals 4*a* to 4*c* while holding the cables 60*a* to 60*c*. Alternatively, a connecting terminal holding member for directly holding the first connecting terminals 4*a* to 4*c* without holding the cables 60*a* to 60*c* may be used in place of the resin molded body 10.

In a case that the resin molded body 10 determines the positions of the first connecting terminals 4*a* to 4*c* by holding the cables 60*a* to 60*c* without directly holding the first connecting terminals 4*a* to 4*c*, i.e., in the case as is the present embodiment, use of flexible cables 60*a* to 60*c* allows the tips of the first connecting terminals 4*a* to 4*c* to flexibly move with respect to the first terminal housing 5, and it is thereby possible to suppress deformation of the first connecting terminals 4*a* to 4*c* caused by pressure from the connecting member 9.

In the first connector portion 2, a protrusion 11 to be locked inside a cylinder of the resin molded body 10 holding the cables 60*a* to 60*c* to restrict backward movement (toward the left side in FIG. 1) of the cables 60*a* to 60*c* is each formed at proximal ends of the first connecting terminals 4*a* to 4*c* (in the vicinity of the cables 60*a* to 60*c*) so that the cables 60*a* to 60*c* are not pulled out from the resin molded body 10 even when the cables 60*a* to 60*c* are pulled.

Figure 4A:
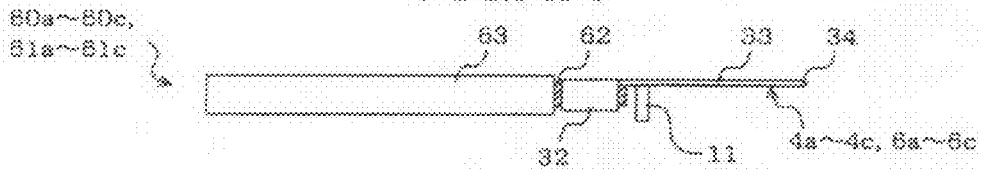
Figure 4B:
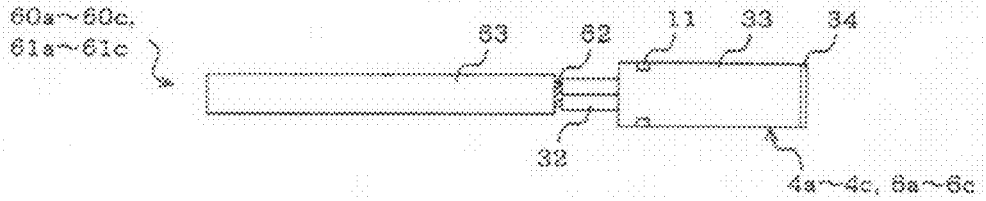

As shown in FIG. 4A, each of the first connecting terminals 4*a* to 4*c* has a caulking portion 32 for caulking the conductor 62 which is exposed at end portions of the cables 60*a* to 60*c* and a plate-like contact point 33 integrally formed with the caulking portion 32. The protrusions 11 are formed to protrude upward (downward) from both widthwise end portions of the plate-like contact point 33 at the proximal end thereof. In addition, a tip portion 34 of the plate-like contact point 33 is chamfered in order to improve insertability of the terminals.

Referring to FIGS. 1 to 3 again, in the present embodiment, the connecting member 9 has a ring-shaped support 91 fixed to the first terminal housing 5, a rotating portion 92 of which upper portion is inserted into a ring-shaped hollow of the support 91 so as to be rotatably supported thereby, a core cylinder 93 housed in the rotating portion 92 so as to vertically move in accordance with rotation of the rotating portion 92, an elastic member 15 housed in the rotating portion 92 and a pressing portion 94 integrally attached to the tip of the elastic member 15.

An irregular-shaped hole (a star-shaped hole, here) 95 for fitting a tool such as a wrench is formed on the upper surface of the rotating portion 92 (a surface on the upper side in FIG. 3), and the connecting member 9 is configured such that the rotating portion 92 is rotated with respect to the support 91, the core cylinder 93 vertically moves with respect to the support 91 (in a lamination direction which is a vertical direction in FIG. 3) in accordance with the rotation, and the pressing portion 94 which is attached to the tip of the elastic member 15 presses the adjacent insulating member 8*a*.

In the present embodiment, a concave portion 96 is formed on the lower surface of the rotating portion 92 to house the core cylinder 93 therein. This is an idea to reduce a distance between the rotating portion 92 and the insulating member 8*a* and to downsize the connector 1 even when the elastic member 15 is long to some extent. The elastic member 15 is composed of, e.g., a spring formed of metal (e.g., SUS, etc.).

A concave portion 16 for covering (housing) a lower portion of the elastic member 15 is formed on the upper surface of the pressing portion 94 with which the lower portion of the elastic member 15 is in contact, and a receiving member 17 formed of metal (e.g., SUS, etc.) for preventing the pressing portion 94 formed of an insulating resin from being damaged by receiving the elastic member 15 is provided on a bottom of the concave portion 16 (i.e., a seat portion with which the lower portion of the elastic member 15 is in contact).

The receiving member 17 prevents damage of the pressing portion 94 by dispersing stress applied from the elastic member 15 to the upper surface of the pressing portion 94. Therefore, a contact area between the receiving member 17 and the pressing portion 94 is preferably as large as possible. The receiving member 17 having a shape in contact throughout the entire bottom surface of the bottom of the concave portion 16 is provided in the present embodiment in order to increase the contact area between the receiving member 17 and the pressing portion 94.

The first terminal housing 5 is formed of a hollow cylindrical body 20 having a substantially rectangular shaped horizontal cross-section. An outer peripheral portion of one side (on the right side in FIG. 3) of the cylindrical body 20 which is fitted to the second terminal housing 7 is formed in a tapered shape in light of fitting properties to the second connector portion 3. Meanwhile, a terminal housing waterproof structure 21 for sealing between the first connector portion 2 and the second connector portion 3 is provided on the outer peripheral portion of the one side of the cylindrical body 20. The terminal housing waterproof structure 21 is composed of a concave portion 22 formed on the outer peripheral portion of the one side of the cylindrical body 20 and a packing 23 such as an O-ring provided on the concave portion 22.

Inside the cylindrical body 20 on another side (on the left side in FIG. 3), i.e., opposite to the side to be fitted to the second terminal housing 7, only a portion of the resin molded body 10 on the tip side in an insertion direction is housed in the first terminal housing 5 and the remaining portion protrudes outward from the first terminal housing 5. A packing 12 for preventing water from entering into the first terminal housing 5 is provided on the outer periphery of the tip portion (the portion housed in the first terminal housing 5) of the resin molded body 10. In addition, a packing 13 is provided to the resin molded body 10 on a cable insertion side to prevent water from trickling down through the cables 60*a* to 60*c* and entering into the first terminal housing 5.

A flange 24 for fixing the first connector portion 2 to a vehicle body, etc., is formed on the outer periphery of the other side of the cylindrical body 20. The flange 24 has a mounting hole 25 through which a non-illustrated bolt is inserted for fixation to the vehicle body, etc. Although the flange 24 provided on the first connector portion 2 is described in the present embodiment, the flange 24 may be provided on the second connector portion 3 or on both the first connector portion 2 and the second connector portion 3. Alternatively, the flange 24 may be omitted.

Meanwhile, the flange 24 is effective to improve heat dissipation. That is, a surface area of the first terminal housing 5 can be increased by forming the flange 24, and it is thus possible to improve the heat dissipation when heat generated inside the first connector portion 2 (e.g., heat generated at each contact point) is released to the outside through the first terminal housing 5.

A connecting member insertion hole 26 for inserting the connecting member 9 therethrough is formed on the upper portion (on the upper side in FIG. 3) of the cylindrical body 20. A portion of the first terminal housing 5 as a periphery of the connecting member insertion hole 26 is formed in a cylindrical shape (a hollow cylindrical shape).

For shielding performance, heat dissipation and weight saving of the connector 1, the cylindrical body 20 is preferably formed of light metal having high electrical and thermal conductivity such as aluminum, but may be formed of resin, etc. In the present embodiment, the cylindrical body 20 is formed of aluminum.

Second Connector Portion

The second connector portion 3 will be described below.

Figure 5:
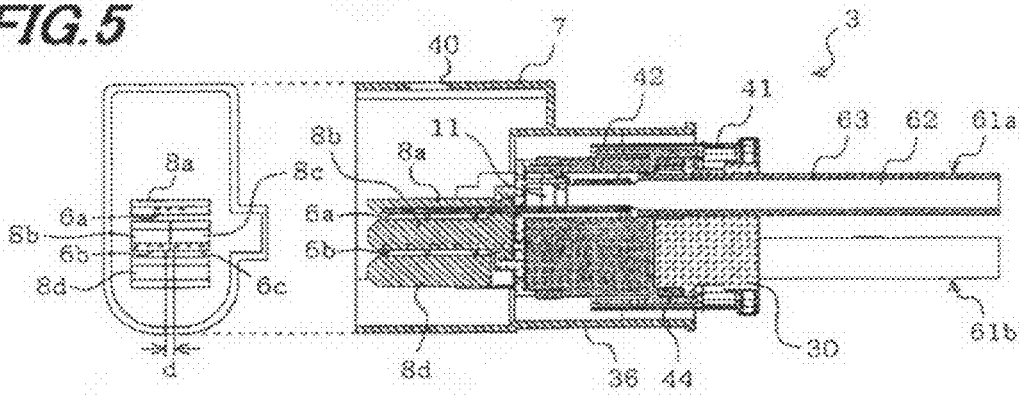
FIG. 5 is a diagram illustrating a second connector portion of the connector of FIG. 1.

As shown in FIGS. 1, 2 and 5, the second connector portion 3 has the second terminal housing 7 in which plural (three) aligned second connecting terminals (female terminals) 6*a* to 6*c* are housed, and plural insulating members 8*a* to 8*d* in a substantially rectangular parallelepiped shape which are provided in the second terminal housing 7 for insulating the second connecting terminals 6*a* to 6*c* from each other.

The cables 61*a* to 61*c* extending from the inverter side are respectively connected to edges of the second connecting terminals 6*a* to 6*c* on one side. The cables 61*a* to 61*c* are respectively electrically connected to the cables 60*a* to 60*c* via the first connecting terminals 4*a* to 4*c* and the second connecting terminals 6*a* to 6*c*, and electricity of different voltage and/or current corresponding to each of the cables 60*a* to 60*c* is transmitted. The cables 61*a* to 61*c* are the same cables as the cables 60*a* to 60*c* and are each composed of the conductor 62 and the insulation layer 63 formed on the outer periphery thereof. Although the same cables as the cables 60*a* to 60*c* are used as the cables 61*a* to 61*c*, cables having different sizes, etc., may be used.

The cables 61*a* to 61*c* are each aligned and held at predetermined intervals by a resin molded body (inner housing) 30 so as to be triangularly-arranged when viewed in a fitting direction. The resin molded body 30 positions and holds the second connecting terminals 6*a* to 6*c* in a triangle shape when viewed in a fitting direction respectively on the first connecting terminals 4*a* to 4*c* (i.e., objects to be connected) which face the second connecting terminals 6*a* to 6*c* to be respectively paired therewith when the first connector portion 2 is fitted to the second connector portion 3.

At this time, it is necessary to determine a distance d between the adjacently-arranged second connecting terminals 6*b* and 6*c* so that insulation between the terminals is sufficiently ensured. It is obvious that it is necessary to determine the distance between the second connecting terminal 6*a* and the second connecting terminals 6*b*, 6*c* so as to ensure insulation therebetween, however, the design therefor is not as inflexible as the distance between the second connecting terminals 6*b* and 6*c* since the insulating members 8*b* and 8*c* are interposed therebetween.

The resin molded body 30 is formed of an insulating resin, etc., to prevent short circuit by insulating the second connecting terminals 6*a* to 6*c* from each other. The resin molded body 30 allows the second connecting terminals 6*a* to 6*c* to be held at respective predetermined positions even though each of the cables 61*a* to 61*c* respectively connected to the second connecting terminals 6*a* to 6*c* is very flexible.

Although the resin molded body 30 positions the second connecting terminals 6*a* to 6*c* by holding the cables 61*a* to 61*c*, it is not limited thereto. The resin molded body 30 may directly hold and position the second connecting terminals 6*a* to 6*c* while holding the cables 61*a* to 61*c*. Alternatively, a connecting terminal holding member for directly holding the second connecting terminals 6*a* to 6*c* without holding the cables 61*a* to 61*c* may be used.

In a case that the resin molded body 30 determines the positions of the second connecting terminals 6*a* to 6*c* by holding the cables 61*a* to 61*c* without directly holding the second connecting terminals 6*a* to 6*c*, i.e., in the case as is the present embodiment, use of flexible cables 61*a* to 61*c* allows the tips of the second connecting terminals 6*a* to 6*c* to flexibly move with respect to the second terminal housing 7, and it is thereby possible to suppress deformation of the second connecting terminals 6*a* to 6*c* caused by pressure from the connecting member 9.

A non-illustrated braided shield is wound around portions of the cables 61*a* to 61*c* which are pulled out from the second terminal housing 7, in order to improve the shielding performance. The braided shield is in contact with a below-described cylindrical shield body 41, and is electrically connected to the first terminal housing 5 via the cylindrical shield body 41 (the same potential (GND)).

In the second connector portion 3, a protrusion 11 is each formed at proximal ends of the second connecting terminals 6*a* to 6*c* (in the vicinity of the cables 61*a* to 61*c*) so that the cables 61*a* to 61*c* are not pulled out from the resin molded body 30 even when the cables 61*a* to 61*c* are pulled, in the same manner as the first connector portion 2. The configuration of the second connecting terminals 6*a* to 6*c* is similar to that of the first connecting terminals 4*a* to 4*c* and the explanation therefor is thus omitted.

Among the insulating members 8*a* to 8*d*, the plural first insulating members 8*a* to 8*c* are aligned and housed in the second terminal housing 7 and are also fixed integrally to the respective surfaces of the plural second connecting terminals 6*a* to 6*c* on another side (surfaces opposite to the surfaces connected to the first connecting terminals 4*a* to 4*c*), and a second insulating member 8*d* is provided so as to face the surfaces of the outermost first connecting terminals 4*b* and 4*c* (the lowermost side in FIG. 3) on another side (surfaces opposite to the surfaces connected to the second connecting terminals 6*b* and 6*c*) when the plural first connecting terminals 4*a* to 4*c* and the plural second connecting terminals 6*a* to 6*c* form a laminated state.

The first insulating members 8*a* to 8*c* are fixed to the second connecting terminals 6*a* to 6*c* at positions to protrude on the tip side. Each corner of the first insulating members 8*a* to 8*c* on a side to insert and extract the first connecting terminals 4*a* to 4*c* is chamfered. In addition, a corner of the second insulating member 8*d* on a side to insert and extract the first connecting terminals 4*a* to 4*c* is also chamfered. Furthermore, a protruding portion (a build-up surface) for filling level difference from the second connecting terminals 6*a* to 6*c* is each formed on the surfaces of the first insulating members 8*a* to 8*c* to which the second connecting terminals 6*a* to 6*c* are fixed so that the lower surfaces (lower side in the drawing) of the plural first insulating members 8*a* to 8*c* are respectively flush with the lower surfaces (lower side in the drawing) of the second connecting terminals 6*a* to 6*c*. Due to this configuration, the tip portions of the second connecting terminals 6*a* to 6*c* do not contact with the tip portions of the first connecting terminals 4*a* to 4*c* to be inserted when the first connector portion 2 is fitted to the second connector portion 3, hence, an effect of improving insertability of the first connecting terminals 4*a* to 4*c*.

The second terminal housing 7 is composed of a hollow cylindrical body 36 having a substantially rectangular horizontal cross section. Since the first terminal housing 5 is fitted in the second terminal housing 7, an inner peripheral portion of the cylindrical body 36 on one side (on the left side in FIG. 5) to be fitted to the first terminal housing 5 is formed in a tapered shape in light of fitting properties to the first terminal housing 5.

The resin molded body 30 aligning and holding the cables 61*a* to 61*c* is housed in the cylindrical body 36 on the other end side (on the right side in FIG. 5). A non-packing airtight portion is provided on the resin molded body 30 on a cable insertion side to prevent water from trickling down through the cables 61*a* to 61*c* and entering into the second terminal housing 7. A packing 44 in contact with the resin molded body 30 is provided on the outer periphery of the non-packing airtight portion.

Furthermore, the outer periphery of the cylindrical body 36 on the other end side from where the cables 61*a* to 61*c* are led out is covered by a rubber boot for preventing water from entering into the cylindrical body 36, even though it is not illustrated.

Meanwhile, a connecting member manipulating hole 40, through which the connecting member 9 provided on the first connector portion 2 is manipulated when the second connector portion 3 is fitted to the first connector portion 2, is formed on an upper portion of the cylindrical body 36 (on the upper side in FIG. 5).

For shielding performance, heat dissipation and weight saving of the connector 1, the cylindrical body 36 is preferably formed of light metal having high electrical and thermal conductivity such as aluminum, but may be formed of resin, etc. Since the cylindrical body 36 is formed of an insulating resin in the present embodiment, the aluminum cylindrical shield body 41 is provided on an inner peripheral surface of the cylindrical body 36 on the other end side in order to improve the shielding performance and the heat dissipation.

The cylindrical shield body 41 has a contact portion 42 which comes in contact with an outer periphery of the aluminum first terminal housing 5 when the first connector portion 2 is fitted to the second connector portion 3, and the cylindrical shield body 41 and the first terminal housing 5 are thermally and electrically connected via the contact portion 42. This improves the shielding performance and the heat dissipation. Significant improvement is expected particularly in the heat dissipation by actively releasing heat to the first terminal housing 5 which is excellent in heat dissipation.

Connection Between First Connector Portion and Second Connector Portion

Figure 6:
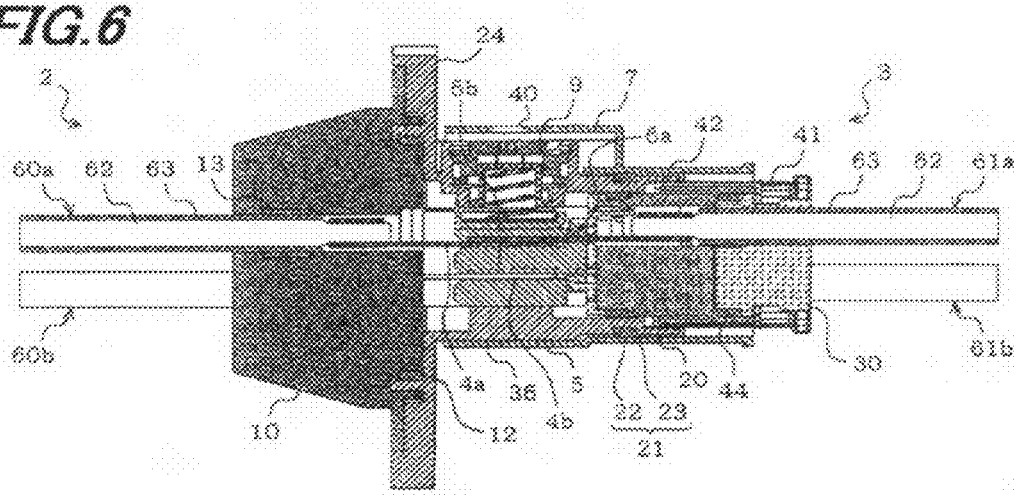
FIG. 6 is a cross sectional view showing a fitted state of the connector of FIG. 1.

As shown in FIG. 6, when the two terminal housings 5 and 7 are fitted to each other, the first connecting terminals 4*a* to 4*c* are respectively inserted into gaps between the respective pairs of the second connecting terminals 6*a* to 6*c* and the insulating members 8*a* to 8*d*. The insertion provides a laminated structure in which the surfaces of the plural first connecting terminals 4*a* to 4*c* on one side face the surfaces of the plural second connecting terminals 6*a* to 6*c* on one side to form the respective pair, and the first connecting terminals 4*a* to 4*c*, the second connecting terminals 6*a* to 6*c* and the insulating members 8*a* to 8*d* are alternately arranged, i.e., the insulating members 8*a* to 8*d* are arranged so as to sandwich the pairs of the first connecting terminals 4*a* to 4*c* and the second connecting terminals 6*a* to 6*c*.

At this time, in the second connector portion 3, since the first insulating members 8*a* to 8*c* are respectively fixed to the tip side of the second connecting terminals 6*a* to 6*c* triangularly-aligned and held at predetermined intervals when viewed in a fitting direction, each gap between the insulating members 8*a* to 8*c* can be kept without additionally providing a retaining jig for keeping gaps between the respective insulating members 8*a* to 8*d* (see Japanese patent No. 4037199). This makes easy to insert the first connecting terminals 4*a* to 4*c* into the gaps between the respective pairs of the second connecting terminals 6*a* to 6*c* and the insulating members 8*a* to 8*d*. In other words, the insertion and extraction properties of the first connecting terminals 4*a* to 4*c* are not degraded. In addition, it is very effective in that it is possible to realize further downsizing as compared to the conventional art since it is not necessary to provide a retaining jig for keeping the gaps between the insulating members 8*a* to 8*d*.

Figure 7:
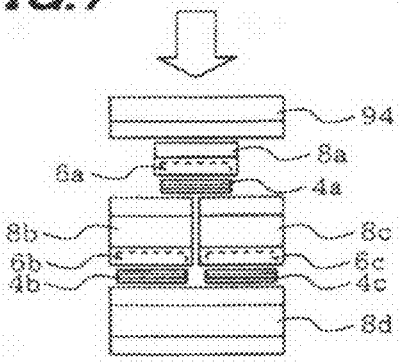
FIG. 7 is an explanatory diagram illustrating connection between first and second connecting terminals of the connector of FIG. 1.

Meanwhile, as shown in FIG. 7, a contact point between the first connecting terminal 4*a* and the second connecting terminal 6*a* is sandwiched by the first insulating member 8*a* fixed to the second connecting terminal 6*a* composing a contact point and the first insulating members 8*b* and 8*c* fixed to the second connecting terminals 6*b* and 6*c* composing other contact points. Likewise, a contact point between the first connecting terminal 4*b* (or 4*c*) and the second connecting terminal 6*b* (or 6*c*) is sandwiched by the first insulating member 8*b* (or 8*c*) fixed to the second connecting terminal 6*b* (or 6*c*) composing a contact point and the second insulating member 8*d*.

When the rotating portion 92 of the connecting member 9 is turned by a tool such as wrench in this state and the core cylinder 93 is pressed downward, the first insulating member 8*a*, the first insulating members 8*b* and 8*c* and the second insulating member 8*d* are pressed in this order by the pressing portion 94 via the elastic member 15, a pressing force is imparted to each contact point by any two or more of the insulating members 8*a* to 8*d* which sandwich and press each contact point, and each contact point comes in contact in a state of being insulated from each other.

That is, the connecting member 9 presses the first connecting terminal 4*a* or the second connecting terminal 6*a* located at a vertex of the triangle shape (the second connecting terminal 6*a* in the present embodiment) and the two parallel-arranged first connecting terminals 4*b* and 4*c* or second connecting terminals 6*b* and 6*c* thereunder are pressed by the first or second connecting terminal located at the vertex of the triangle shape (the second connecting terminal 6*a* in the present embodiment), thereby forming three contact points between the three first connecting terminals 4*a* to 4*c* and the three second connecting terminals 6*a* to 6*c*.

At this time, the first connecting terminals 4*a* to 4*c* and the second connecting terminals 6*a* to 6*c* are bent in some degree due to pressure from the insulating members 8*a* to 8*d* and respectively make contact in a large area. This makes strong contact and fixation of each contact point even under the environment in which vibration occurs, such as in a vehicle.

Effects of the Embodiment

The effects of the present embodiment will be described below.

The connector 1 in the present embodiment is configured such that each arrangement of the three first connecting terminals 4*a* to 4*c* and the three second connecting terminals 6*a* to 6*c* is a triangle when viewed in a fitting direction.

As a result, the cables 60*a* to 60*c* and 61*a* to 61*c* respectively connected to the connecting terminals 4*a* to 4*c* and 6*a* to 6*c* are also triangularly-arranged when viewed in a fitting direction, which allows the cables 60*a* to 60*c* and 61*a* to 61*c* led out from the connector 1 to be easily bundled. Therefore, there is an advantage that it is easy to insert the cables 60*a* to 60*c* and 61*a* to 61*c* into a protection member in a cylindrical shape such as aluminum pipe or corrugated tube.

In addition, the triangular arrangement described in the present embodiment allows the connecting member 9 to evenly press each contact point, and it is thus possible to provide equal connection quality at each contact point.

It should be noted that the present invention is not intended to be limited to the embodiment, and the various changes can be made without departing from the gist of the present invention.

Figure 8A:
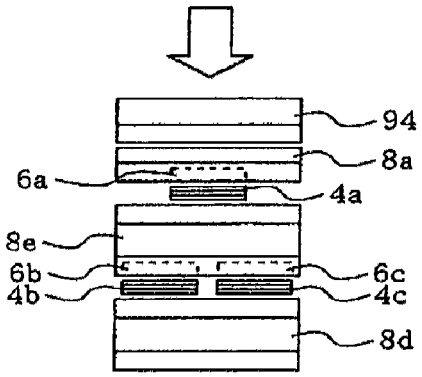
FIGS. 8A to 8C are explanatory diagrams illustrating modifications of the invention.

In the embodiment, for example, two parallel-arranged first insulating members 8*b* and 8*c* are formed as a separate member but may be formed integrally (an first insulating member 8*e*) as shown in FIG. 8A. This allows the number of moving parts to be reduced and the contact points to be pressed more stably, and it is thereby possible to improve reliability as a connector.

Figure 8B:
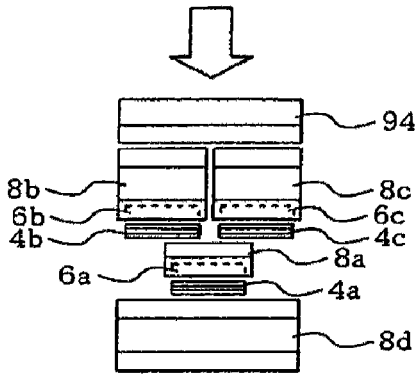
Figure 8C:
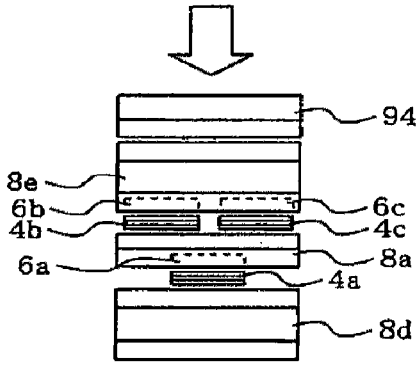

In addition, the embodiment is configured such that the connecting member 9 presses the first connecting terminal 4*a* or the second connecting terminal 6*a* located at a vertex of the triangle shape (the second connecting terminal 6*a* in the embodiment) and the two parallel-arranged first connecting terminals 4*b* and 4*c* or second connecting terminals 6*b* and 6*c* thereunder are pressed by the first or second connecting terminal located at the vertex of the triangle shape (the second connecting terminal 6*a* in the embodiment) to form three contact points, however, it may be configured, as shown in FIG. 8B, such that the connecting member 9 presses the two parallel-arranged first connecting terminals 4*b* and 4*c* or second connecting terminals 6*b* and 6*c* and the first connecting terminal 4*a* or the second connecting terminal 6*a* thereunder located at a vertex of the triangle shape is pressed by the two parallel-arranged first connecting terminals 4*b* and 4*c* or second connecting terminals 6*b* and 6*c* to form three contact points. Also in this case, the first insulating members 8*b* and 8*c* may be formed integrally (the first insulating member 8*e*) as described above.

In addition, the embodiment assumes the use of a three-phase AC power line, however, according to the technical idea of the invention, it may be, e.g., a connector for a vehicle which is configured to collectively connect lines used for different purposes such as a three-phase AC power line between a motor and an inverter and a two-phase DC power line for air conditioner. Since the configuration described above allows one connector to collectively connect power lines used for plural purposes, it is not necessary to prepare different connectors for each intended purpose and it is thus possible to contribute to space saving and cost reduction.

Alternatively, terminal surfaces of the first connecting terminals 4*a* to 4*c* and the second connecting terminals 6*a* to 6*c* may be each roughened by a knurling process to increase frictional force so as to make the terminals difficult to move, thereby strengthening the fixation at each contact point.

In addition, although the first connecting terminals 4*a* to 4*c* provided at the end portions of the cables 60*a* to 60*c* have been described in the embodiment, it is not limited thereto. The first connecting terminals 4*a* to 4*c* may be a bus bar, etc., to which a cable is not connected.

In addition, although a cable excellent in flexibility is used as the cables 60*a* to 60*c* and 61*a* to 61*c* in the embodiment, a rigid cable may be used.

In addition, in the present embodiment, a direction of the connecting member 9 may be either substantially horizontal or substantially vertical when the connector is in use. In other words, a direction in a usage state is not a requirement in the use conditions of the connector of the present embodiment.

In addition, although the pressing portion 94 presses the first insulating member 8*a* adjacent thereto via the elastic member 15 which is a portion of the connecting member 9 in the embodiment, the adjacent first insulating member 8*a* may be pressed directly by the core cylinder 93, not via the elastic member 15 and the pressing portion 94.

Although the case of providing the connecting member 9 on only one side of the first terminal housing 5 has been described in the embodiment, the connecting member 9 may be provided on both sides of the first terminal housing 5 so that a pressing force is imparted to each contact point by the connecting members 9 provided on the both sides.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A connector, comprising:

a first terminal housing for housing three first connecting terminals aligned;

a second terminal housing for housing three second connecting terminals aligned;

a plurality of insulating members that are aligned and housed in the second terminal housing;

a laminated structure that the three first connecting terminals and the three second connecting terminals are alternately arranged so that one surface of the three first connecting terminals faces one surface of the three second connecting terminals to form pairs and to form three contact points sandwiched between the plurality of insulating members when the first terminal housing is fitted to the second terminal housing; and a connecting member for collectively fixing and electrically connecting the three first connecting terminals and the three second connecting terminals at each contact point by pressing one of the plurality of insulating members adjacent to the connecting member, wherein the three first connecting terminals and the three second connecting terminals are each arranged in a form of a triangle when viewed in the fitting direction.

2. The connector according to claim 1, wherein the three contacts are formed between the three first connecting terminals and the three second connecting terminals such that the connecting member presses one terminal of the three first connecting terminals or the three second connecting terminals located at a vertex of the triangle, and the one of the three first connecting terminals or the three second connecting terminals located at the vertex of the triangle presses two parallel-arranged terminals of the three first connecting terminals or the three second connecting terminals located thereunder.

3. The connector according to claim 1, wherein the three contacts are formed between the three first connecting terminals and the three second connecting terminals such that the connecting member presses two parallel-arranged terminals of the three first connecting terminals or the three second connecting terminals, and the two parallel-arranged terminals of the three first connecting terminals or the three second connecting terminals press one terminal of the three first connecting terminals or the three second connecting terminals located thereunder and at a vertex of the triangle.

4. The connector according to claim 1, further comprising a resin molded body for holding three cables to be each connected to the three first connecting terminals such that the three cables are arranged in a form of a triangle when viewed in the fitting direction.

5. The connector according to claim 1, further comprising a resin molded body for holding three cables to be each connected to the three second connecting terminals such that the three cables are arranged in a form of a triangle when viewed in the fitting direction.

* * * * *